US009422631B2

(12) United States Patent
Bulan et al.

(10) Patent No.: US 9,422,631 B2
(45) Date of Patent: Aug. 23, 2016

(54) METHOD OF OPERATING AN OXYGEN-CONSUMING ELECTRODE

(75) Inventors: Andreas Bulan, Langenfeld (DE); Michael Groβholz, Leverkusen (DE)

(73) Assignee: Covestro Deutschland AG (DE)

( * ) Notice: Subject to any disclaimer, the term of this patent is extended or adjusted under 35 U.S.C. 154(b) by 1007 days.

(21) Appl. No.: 13/406,600

(22) Filed: Feb. 28, 2012

(65) Prior Publication Data

US 2012/0222965 A1 Sep. 6, 2012

(30) Foreign Application Priority Data

Mar. 4, 2011 (DE) ..... 10 2011 005 133

(51) Int. Cl.
*C25B 15/02* (2006.01)
*C25B 1/46* (2006.01)
*C25B 1/26* (2006.01)

(52) U.S. Cl.
CPC . *C25B 1/46* (2013.01); *C25B 1/26* (2013.01); *C25B 15/02* (2013.01)

(58) Field of Classification Search
USPC ..... 205/510, 515, 525, 618, 620, 624
See application file for complete search history.

(56) References Cited

U.S. PATENT DOCUMENTS

| | | | | |
|---|---|---|---|---|
| 3,479,261 | A * | 11/1969 | Heredy | 205/354 |
| 3,963,592 | A | 6/1976 | Lindstrom | |
| 4,090,932 | A * | 5/1978 | Kazihara et al. | 205/516 |
| 4,105,515 | A | 8/1978 | Ogawa et al. | |
| 4,329,209 | A * | 5/1982 | Johnson | 205/512 |
| 6,165,332 | A | 12/2000 | Gestermann et al. | |
| 2004/0245118 | A1 | 12/2004 | Gestermann et al. | |
| 2005/0056549 | A1 | 3/2005 | Gestermann et al. | |

FOREIGN PATENT DOCUMENTS

| | | | |
|---|---|---|---|
| DE | 2729589 | A1 | 6/1977 |
| DE | 19622744 | C1 | 7/1997 |
| DE | 10149779 | A1 | 4/2003 |
| DE | 10159372 | A1 | 6/2003 |
| DE | 10342148 | A1 | 4/2005 |
| EP | 1033419 | A1 | 9/2000 |
| EP | 1120481 | A1 | 8/2001 |
| JP | 58120788 | A | 7/1983 |
| WO | WO-2008/006909 | A2 | 1/2008 |

OTHER PUBLICATIONS

European Search Report for EP12157043 dated May 27, 2014.
Moussallem, I., et al., *Chlor-alkali electrolysis with oxygen depolarized cathodes: history, present status and future prospects* (2008), J. Appl. Electrochem, 38, pp. 1177-1194.
Lipp, L., et al., *Peroxide formation in a zero-gap chlor-alkali cell with an oxygen-depolarized cathode* (2005), Journal of Applied Electrochemistry, 35, pp. 1015-1024.

* cited by examiner

*Primary Examiner* — Arun S Phasge
(74) *Attorney, Agent, or Firm* — Drinker Biddle & Reath LLP

(57) ABSTRACT

The present invention relates to a method of operating an oxygen-consuming electrode as cathode for the electrolysis of alkali metal chlorides or hydrochloric acid, in an electrochemical cell, comprising feeding an oxygen-containing process gas to the electrode, wherein the oxygen-containing process gas is at least partly heated using a heat source from the electrolysis before contact with the oxygen-consuming electrode to a temperature which corresponds to not more than the temperature of the cathode space in the cell or is less than 50° C. below the temperature of the cathode space in the cell.

16 Claims, 3 Drawing Sheets

METHOD OF OPERATING AN OXYGEN-CONSUMING ELECTRODE

CROSS REFERENCE TO RELATED APPLICATIONS

Priority is claimed to German Patent Application No. 10 2011 005 133.3, filed on Mar. 4, 2011, which is incorporated herein by reference in its entirety for all useful purposes.

BACKGROUND

The invention relates to a method of conditioning an oxygen-containing process gas in an electrochemical process in which a gas diffusion electrode, in particular an oxygen-consuming electrode, is used. Here, electrochemical processes are, in particular, chloralkali and hydrochloric acid electrolysis using oxygen-consuming electrodes.

The use of gas diffusion electrodes enables energy savings to be achieved in various electrochemical processes, and in addition the formation of undesirable or uneconomical by-products is avoided.

One example of a gas diffusion electrode is the oxygen-consuming electrode (OCE). Oxygen-consuming electrodes are employed, inter alia, in chloralkali electrolysis, hydrochloric acid electrolysis, fuel cell technology or metal/air batteries.

The invention proceeds from oxygen-consuming electrodes known per se which are configured as gas diffusion electrodes and usually comprise an electrically conductive support and a gas diffusion layer having a catalytically active component.

Various proposals for operating the oxygen-consuming electrodes in electrolysis cells of industrial size are known in principle from the prior art. The basic idea here is to replace the hydrogen-evolving cathode of the electrolysis (for example in chloralkali electrolysis) by an oxygen-consuming electrode (cathode). An overview of possible cell designs and solutions may be found in the publication by Moussallem et al "Chlor-Alkali Electrolysis with Oxygen Depolarized Cathodes: History, Present Status and Future Prospects", J. Appl. Electrochem. 38 (2008) 1177-1194.

Oxygen-consuming electrodes according to the prior art are used in various arrangements in electrochemical processes, for example in the generation of electric power in fuel cells or in the electrolytic preparation of chlorine from aqueous solutions of sodium chloride. A more detailed description of chloralkali electrolysis using an oxygen-consuming electrode may be found in Journal of Applied Electrochemistry, Vol 38 (9) page 1177-1194 (2008). Examples of electrolysis cells having oxygen-consuming electrodes may be found in the documents EP 1033419B1, DE 19622744C1 and WO 2008006909A2.

The electrolysis of sodium chloride or hydrochloric acid is carried out industrially in plants having capacities of up to over 1 million t of chlorine/annum. The plants encompass not only the electrolysis apparatuses but also facilities for working up chlorine and sodium hydroxide and, if a conventional electrolysis without OCE is operated, hydrogen. Descriptions of the work-up processes may be found, for example, in the sections "Chlorine" and "Sodium Hydroxide" of the on-line edition of Ullmann's Encyclopedia of Industrial Chemistry, Wiley-VCH Verlag GmbH & Co KG, Weinheim.

A further development direction for the utilization of OCE technology in chloralkali electrolysis is the ion-exchange membrane which separates the anode space from the cathode space in the electrolysis cell without the sodium hydroxide gap being located directly on the OCE. This arrangement is also referred to as the zero gap arrangement in the prior art. This arrangement is usually also employed in fuel cell technology. A disadvantage here is that the sodium hydroxide formed has to be conveyed through the OCE to the gas side and subsequently flows downward on the OCE. This must not lead to blockage of the pores in the OCE by the sodium hydroxide or to crystallization of sodium hydroxide in the pores. It has been found that very high sodium hydroxide concentrations can also occur, and the ion-exchange membrane is not stable to these high concentrations in the long term (Lipp et al, J. Appl. Electrochem. 35 (2005)1015—Los Alamos National Laboratory "Peroxide formation during chlor-alkali electrolysis with carbon-based ODC").

A method of recirculating the unconsumed oxygen coming from the electrolysis to the electrolysis is described in DE10149779 A1. In the method described in DE10149779 A1, the fresh oxygen added is depressurized in a gas jet pump and the resulting suction pressure is used for drawing-in the unconsumed oxygen coming from the electrolysis cell. Intimate mixing of fresh oxygen with recycled oxygen occurs in the nozzle.

In principle, a small amount of hydrogen can be formed by means of a secondary reaction in all electrolyses using an OCE and this then leaves the electrolysis cell together with the excess oxygen. On recirculation of the hydrogen-containing oxygen coming from the cell, the hydrogen accumulates and ignitable mixtures can be formed. To avoid a dangerous accumulation of hydrogen and also an undesirable accumulation of other extraneous gases, part of the gas stream leaving the cell is removed as purge stream from the circuit. A further measure to counter dangerous accumulations of hydrogen is the removal by means of catalytic oxidation as described in DE 10342148.

DE10159372 A1 mentions heating and humidification of the process gas as possible variants for an electrochemical half cell having an OCE, but without disclosing further information about the precise temperature conditions, concentrations and appropriate embodiments.

In process technology, heating of process gases is generally effected by means of a heat exchanger which is heated by means of an external energy source such as steam. The temperature of the process gas is controlled by appropriate regulating devices. The regulating devices require additional investment, and the use of an additional external energy source likewise increases the capital costs and also increases the total energy consumption of the process.

It is an object of the present invention to provide a method of heating process gas for use in electrolysis cells having oxygen-consuming electrodes, which method overcomes the above disadvantages.

A specific object of the present invention is to provide a method which allows heating of oxygen-containing feed gas in the electrochemical preparation of chlorine by means of electrolysis apparatuses having OCEs with a minimal outlay in terms of apparatus and instrumentation and without additional energy input.

A particular object of the present invention is to provide a method which allows heating and additionally humidification of oxygen-containing feed gas in the electrochemical preparation of chlorine by means of electrolysis apparatuses having OCEs with a minimal outlay in terms of apparatus and instrumentation and without additional energy input.

The object is achieved by heating the oxygen-containing process gas using heat sources present in the electrolysis process itself or in the subsequent work-up processes.

BRIEF DESCRIPTION OF PREFERRED EMBODIMENTS

An embodiment of the present invention provides a method of operating an oxygen-consuming electrode as cathode for the electrolysis of alkali metal chlorides or hydrochloric acid, in an electrochemical cell, comprising feeding an oxygen-containing process gas to the electrode, wherein the oxygen-containing process gas is at least partly heated using a heat source from the electrolysis before contact with the oxygen-consuming electrode to a temperature which corresponds to not more than the temperature of the cathode space in the cell or is less than 50° C. below the temperature of the cathode space in the cell.

Another embodiment of the present invention is the above method, wherein the oxygen-containing process gas is at least partly heated by heat exchange with a selected process stream obtained from the electrolysis or by heat exchange with a worked-up process stream subsequent to the electrolysis.

Another embodiment of the present invention is the above method, wherein the oxygen-consuming electrode is at least partly heated to a temperature which corresponds to not more than the temperature of the cathode space in the cell or is less than 20° C. below the temperature of the cathode space in the cell.

Another embodiment of the present invention is the above method, wherein the oxygen-consuming electrode is at least partly heated to a temperature which corresponds to not more than the temperature of the cathode space in the cell or is less than 10° C. below the temperature of the cathode space in the cell.

Another embodiment of the present invention is the above method, wherein chlorine gas taken off from the anode side of the electrochemical cell is utilized as a process stream for the heat exchange for heating the oxygen-containing process gas.

Another embodiment of the present invention is the above method, wherein catholyte and/or anolyte leaving the cell is utilized as a process stream for the heat exchange for heating the oxygen-containing process gas.

Another embodiment of the present invention is the above method, wherein cooling water, condensates or secondary steam from an alkali metal hydroxide solution evaporation plant downstream of the electrolysis cell is utilized as a process stream for the heat exchange for heating the oxygen-containing process gas.

Another embodiment of the present invention is the above method, wherein the oxygen-containing process gas is at least partly heated by passing the oxygen-containing process gas through an alkali metal hydroxide solution discharged from a catholyte circuit.

Another embodiment of the present invention is the above method, wherein condensed vapour from an alkali metal hydroxide solution evaporation downstream of the electrochemical cell is used as a process stream for heating the oxygen-containing process gas, wherein the oxygen-containing process gas is heated by passing the oxygen-containing process gas through the condensed vapour.

Another embodiment of the present invention is the above method, wherein the oxygen-containing process gas fed to the electrode has a proportion of from 30 to 95% by volume of oxygen.

Another embodiment of the present invention is the above method, wherein the oxygen-containing process gas fed to the electrode has a proportion of from 90 to 99% by volume of oxygen.

Another embodiment of the present invention is the above method, wherein the oxygen-containing process gas fed to the electrode has a proportion of greater than 99% by volume of oxygen.

Another embodiment of the present invention is the above method, wherein the oxygen-containing process gas fed to the electrode has a $CO_2$ content of <100 ppm.

Another embodiment of the present invention is the above method, wherein the electrolysis is a chloralkali electrolysis.

Another embodiment of the present invention is the above method, wherein the electrolysis is a sodium chloride electrolysis.

Another embodiment of the present invention is the above method, wherein the electrolysis is a hydrochloric acid electrolysis.

BRIEF DESCRIPTION OF THE DRAWINGS

Another embodiment of the present invention is the above method, wherein the electrolysis is a hydrochloric acid electrolysis.

The foregoing summary, as well as the following detailed description of the invention, may be better understood when read in conjunction with the appended drawings. For the purpose of assisting in the explanation of the invention, there are shown in the drawings representative embodiments which are considered illustrative. It should be understood, however, that the invention is not limited in any manner to the precise arrangements and instrumentalities shown.

In the drawings:

FIG. 1 illustrates an electrolysis apparatus and flow diagram according an embodiment.

FIG. 2 illustrates an electrolysis apparatus and flow diagram according another embodiment.

FIG. 3 illustrates an electrolysis apparatus and flow diagram according another embodiment.

DETAILED DESCRIPTION OF PREFERRED EMBODIMENTS

Figure 1:
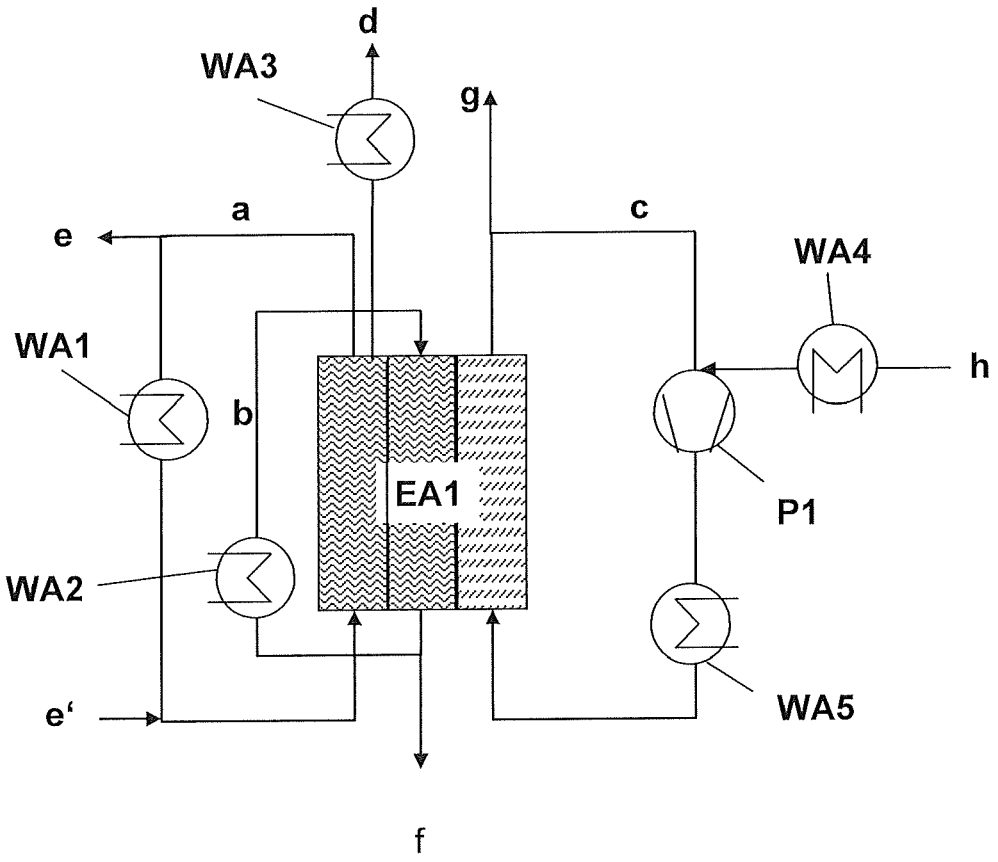

As used herein, the singular terms "a" and "the" are synonymous and used interchangeably with "one or more" and "at least one," unless the language and/or context clearly indicates otherwise. Accordingly, for example, reference to "a heat source" herein or in the appended claims can refer to a single heat source or more than one heat source. Additionally, all numerical values, unless otherwise specifically noted, are understood to be modified by the word "about."

The invention provides a method of operating an oxygen-consuming electrode as cathode for the electrolysis of alkali metal chlorides or hydrochloric acid, in the case of hydrochloric acid by reaction of protons and oxygen, at the electrode in an electrochemical cell, characterized in that the oxygen-containing process gas fed to the electrode is at least partly heated by means of a heat source from the electrolysis, in particular by heat exchange with a selected process stream obtained from the electrolysis or by means of a work-up process stream subsequent to the electrolysis before contact with the oxygen-consuming electrode to a temperature which corresponds to not more than the temperature of the catholyte in the cell or is less than 50° C. below, preferably less than 20° C. below, particularly preferably less than 10° C. below, this temperature.

The oxygen is, for process-related reasons, typically introduced in excess and unconsumed oxygen is discharged again from the cell. The excess of oxygen can be selected over a wide range, and the excess is generally 5-100% of the amount required for the reaction. The oxygen discharged from the cell is mixed with fresh oxygen and returned to the cell. To avoid accumulation of undesirable extraneous gases, a small part, generally 0.5-20%, of the oxygen discharged from the cell is removed from the circuit in a purge stream.

Preference is given to using pure oxygen (>99% by volume of $O_2$) for the introduction of the fresh oxygen: however, it is also possible to use a gas having a lower oxygen concentration (90-99% by volume of $O_2$) or oxygen-enriched air (30-95% by volume of $O_2$). The use of air is in principle also conceivable in chloralkali electrolysis using an OCE, but in this case particularly $CO_2$-free air should be used in order to avoid alkali metal carbonate formation. The terms process gas and feed gas used in the following description are in each case oxygen-containing gas mixtures including pure oxygen. Oxygen is obtained industrially from air by liquefaction and subsequent fractional distillation (cryogenic separation), by selective absorption/desorption on suitable absorbents (pressure swing absorption, PSA). A further, less widely used method is separation by means of membranes. Cryogenic separation generally gives a very pure oxygen containing >99.9% by volume of $O_2$, while the pressure swing or membrane separation processes usually produce oxygen containing 90-95% by volume of $O_2$. The oxygen from such sources usually contains only small traces of water (<1 ppm).

The process gas stream entering the electrolysis cell should if possible have a temperature which corresponds to the temperature in the cell or is only insignificantly below the temperature in the electrolysis cell. Otherwise, a temperature gradient arises within the electrolysis cell, leading to nonuniform distribution of the electrolysis power and streams of materials over the area of the electrode, which results in decreased performance and over time to damage to the membrane and the OCE.

The moisture content of the oxygen entering the electrolysis cell should if possible be sufficiently high for at least the amount of water transported by the exiting oxygen to be compensated. Since the water in the purge stream is no longer returned to the cell, at least this part has to be reintroduced, and in arrangements without recirculation of the feed gas the entire amount of water discharged has to be replaced. When the cell is operated in the zero gap arrangement, in which the OCE is in contact with the ion-exchange membrane, it is customary to introduce additional amounts of water into the electrolysis cell by humidifying the oxygen stream in order to avoid an excessively high concentration of the alkali metal hydroxide which would damage the membrane or even crystallization of the alkali metal hydroxide. To humidify the oxygen, the water has to be vaporized, which requires supply of energy.

Heating can, in particular, be carried out so that only the oxygen-containing gas which is freshly introduced into the process is heated by means of a heat source from the electrolysis. In the case of arrangements without recirculation of the excess oxygen, this is the embodiment carried out, but it can also be carried out in the case of recirculation of the oxygen-containing process gas. When the excess oxygen is recirculated, heating can, however, also be carried out in such a way that the recycled oxygen-containing process gas which is reduced by a proportion of offgas stream is firstly combined with the freshly introduced oxygen and the combined gas stream is heated by means of a heat source from the electrolysis. Discharge of the offgas stream serves to avoid enrichment of the oxygen-containing process gas with undesirable secondary constituents such as hydrogen or inert gases when the oxygen-containing process gas is circulated.

According to the invention, the oxygen-containing process gas is heated utilizing process heat which arises in the electrolysis process and/or a downstream work-up of process streams. Process heat having a low energy level, i.e. heat sources having a temperature of <150° C., preferably <120° C., particularly preferably <100° C., is preferably utilized for heating. The utilization of the secondary heat sources is preferably effected by direct heat exchange in a heat exchanger. However, indirect heat exchange can also be carried out using a further heat transfer medium as intermediary.

In a preferred embodiment of the invention, the chlorine gas taken off from the anode side of the electrochemical cell is utilized as process stream for the heat exchange for heating the oxygen-containing process gas.

In another preferred embodiment of the invention, the catholyte and/or anolyte leaving the cell is used as process stream for the heat exchange for heating the oxygen-containing process gas.

Preference is also given to a method in which cooling water, condensates or secondary steam from an alkali metal hydroxide evaporation plant downstream of the electrolysis cell is utilized for heating the oxygen-containing process gas.

The heating and humidification of the oxygen-containing process gas is particularly preferably carried out by passing the process gas through alkali metal hydroxide solution, in particular sodium hydroxide solution, discharged from the catholyte circuit.

Particular preference is given to using condensed vapour from an alkali metal hydroxide, in particular sodium hydroxide, evaporation downstream of the electrochemical cell as process steam for heating and humidifying the oxygen-containing process gas, with the heat exchange occurring, in particular, by passing the oxygen-containing process gas through the condensed vapour.

The utilization of process heat which arises in the electrolysis process and/or the subsequent work-up at the same time reduces the consumption of cooling energy, which further improves the economics and the environmental friendliness of the process.

The secondary heat sources utilized according to the method of the invention can supply not only the energy for heating the oxygen-containing process gas but also the energy required for the vaporization of water in a preferred humidification of the oxygen-containing process gas. The humidification of the oxygen-containing process gas is carried out in a manner known to those skilled in the art, for example by passing the process gas through a water column or a trickle column supplied with water. The amount of water introduced via the humidification is selected so that at least the water discharged with the potential offgas stream is replaced.

In the operation of an OCE in an electrochemical process, many secondary heat sources are available for heating the oxygen-containing process gas; these will be described in more detail below for chloralkali electrolysis, but without implying a restriction of the invention to these examples.

Thus, the chlorine gas discharged from the electrolysis can be utilized as heat source. The chlorine discharged from the electrolysis has the temperature of the electrolysis cell and thus a temperature which is preferred for introduction of process gas into the cell. In the work-up of the chlorine discharged from the electrolysis cell, the chlorine is typically cooled before the further drying and purification (see Ullmann's Encyclopedia of Industrial Chemistry, chapter "Chlorine", Wiley-VCH Verlag GmbH & Co KG, Weinheim). In general, cooling is effected by means of external cooling media, for example cooling tower water. When the heat of the chlorine taken off from the electrolysis is utilized for preheating the process gas, external cooling energy is thus additionally saved. Heat exchange between the oxygen-containing process gas and the chlorine is preferably carried out in countercurrent in a heat exchanger. The heat exchanger is configured in a manner known to those skilled in the art. Thus, it is possible to use plate heat exchangers, shell-and-tube heat exchangers or other embodiments. Possible materials are the oxygen- and chlorine-resistant materials which are known in principle to those skilled in the art. A preferred resistant material is titanium. The variant described here is also characterized in that no regulating devices for regulating the temperature are required; overheating of the oxygen-containing process gas is not possible—the process gas is brought to the temperature level prevailing in the electrolysis cell.

Further heat sources for heating the oxygen-containing process gas are process streams from the anolyte circuit and/or the catholyte circuit. Due to electric losses in the electrolysis cell, both anolyte and catholyte process streams heat up during the electrolysis. The degree to which they are heated increases with an increase in the current density. To avoid boiling of the electrolytes, the process streams have to be cooled in the circuits. According to the prior art, cooling is effected by means of external cooling media, for example cooling tower water. The heat arising in the anolyte circuit and/or catholyte circuit in normal operation is sufficient to bring the fresh oxygen for the OCE to the required temperature level. During start-up of the cells and during part-load operation with a low current density, it can be necessary to employ not only the waste heat from the anolyte circuit and/or the catholyte circuit but also further energy sources for heating the oxygen.

To heat the oxygen-containing process gas, it is also possible to utilize, independently of the abovementioned heat sources, further secondary heat sources from the work-up processes for products from the electrolysis downstream of the electrolysis, for example the waste heat arising in the work-up of chlorine or the evaporation of the sodium hydroxide solution. Thus, in processes known per se, the sodium hydroxide solution is, for example, concentrated by distillation from the concentration of about 32% achieved in the electrolysis to the usual commercial concentration of 50% (see Ullmann's Encyclopedia of Industrial Chemistry, chapter "Sodium Hydroxide", Wiley-VCH Verlag GmbH & Co KG, Weinheim). This evaporation produces vapour which has to be condensed by cooling. The concentrated sodium hydroxide solution leaves the last evaporation stage at a temperature of, for example, >150° C. and is cooled down to a temperature of typically <50° C. for storage and transport. Both the heat liberated in the condensation of the vapour and also the heat liberated during cooling of the hot sodium hydroxide solution can therefore each preferably be used for preheating the oxygen-containing feed gas. Steam having a low pressure level, as can be generated, for example, during cooling of the sodium hydroxide solution having a temperature above 150° C. or by depressurization of condensate, can also be utilized for preheating the oxygen-containing feed gas.

Furthermore, vapour condensates or condensates arising in the heating of the evaporation plant can be utilized, in particular, for preheating the oxygen-containing feed gas.

The secondary heat sources to be used according to the method of the invention can additionally provide the energy required for vaporizing the water in humidification of the oxygen-containing process gas with water.

Preheated water having a temperature which is equal to or higher than the temperature of the oxygen-containing process gas can preferably be used for humidification. The temperature of the water can, in particular, be chosen so that the oxygen-containing process gas leaving the humidification apparatus has the temperature intended for introduction into the electrolysis cell. However, the process gas can also be brought to the intended temperature in a further heat exchanger after humidification.

Heating of the water is preferably carried out by means of a heat exchanger using one of the abovementioned process streams as heat source. However, it is also possible to utilize, in particular, warm condensate arising in the plant directly for the humidification of the oxygen-containing process gas. Thus, for example, condensed vapour which can be used directly for humidification of the process gas is obtained during concentration of the sodium hydroxide solution in an evaporation apparatus. In addition, the sodium hydroxide solution discharged from the electrolysis, which typically has a concentration of about 32% by weight, can be used instead of water for humidifying the oxygen-containing process gas. This variant has the further advantage that less water has to be evaporated in the downstream evaporation.

The humidification of the oxygen-containing process gas can also be carried out using cold water or water having a temperature lower than the temperature of the oxygen introduced. Such a process has advantages when, for example, the water content in the process gas is to be limited or when the outlay in terms of apparatus is to be kept low. In this variant, the process gas cools during humidification and is subsequently reheated. One of the abovementioned heat sources is used for heating. It can also be advantageous to preheat the water used for humidification by means of one of the heat sources, for example when the temperature of the water is below the intended temperature of the process gas. This is advantageous particularly when a defined moisture content below the saturation limit is intended for the process gas introduced into the electrolysis cell.

The abovementioned variants of the preheating of the oxygen can also be freely combined with one another when this appears to be advantageous from a process engineering point of view.

In a further embodiment, steam having a low pressure level, which is obtained, for example, in the evaporation plant, is utilized for humidifying and heating the oxygen-containing process gas. It is utilized, for example, by injecting this steam into the process gas stream.

The novel method is preferably carried out with the oxygen-containing gas mixture fed into the electrolysis cell, in particular a mixture of fresh oxygen and recycled oxygen, having a temperature which is less than 50° C. below, preferably less than 20° C. below, particularly preferably less than 10° C. below, the temperature in the cell.

The recirculation and mixing of the oxygen can be carried out by means of a gas jet pump as per the method described in DE 10149779A1. However, the recirculation and mixing of the oxygen can also be carried out in another way which is known to those skilled in the art. Thus, the oxygen discharged from the electrolysis cell can be drawn off by means of a pump or a compressor, compressed and then mixed with the fresh oxygen in a mixing device. Mixing can also be carried out directly during introduction into the electrode space.

The method of the invention can be employed regardless of the quality of the freshly introduced oxygen. Thus, the novel method can, in particular, preferably be employed in electrochemical processes in which an OCE is used and pure oxygen (>99% by volume of $O_2$) is fed in. The novel method can likewise be employed in electrochemical processes in which an OCE is used and highly enriched oxygen (90-99% by volume of $O_2$) or enriched oxygen (30-95% by volume of $O_2$) or else $CO_2$-free air (<100 ppm of $CO_2$) is introduced.

Preference is therefore given to an embodiment of the novel method which is characterized in that the oxygen-containing gas mixture supplied to the electrode has a proportion of 30-95% by volume of oxygen, preferably an oxygen content of 90-99% by volume, particularly preferably an oxygen content of >99% by volume.

Preference is also given to a method in which the oxygen-containing gas mixture supplied to the electrode has a $CO_2$ content of <100 ppm.

The method of the invention can be employed regardless of the stoichiometric excess of oxygen fed into the cell and also regardless of the proportion of offgas discharged. The method can, in particular, be employed with the customary 1.05-2-fold stoichiometric excess and a purge gas stream of 0.5-20% of the recirculated feed gas.

The method can in principle be used in all electrochemical processes having an OCE.

The method of the invention can likewise be used in the operation of an alkaline fuel cell, in mains water treatment, for example for the preparation of sodium hypochlorite, or in chloralkali electrolysis, in particular for the electrolysis of LiCl, KCl or NaCl.

The method of the invention is preferably employed when an OCE is used in chloralkali electrolysis and here in particular in the electrolysis of sodium chloride (NaCl) or in hydrochloric acid electrolysis.

The invention is illustrated by way of example below without the invention being restricted to the embodiments described.

EXAMPLES

Example 1

FIG. 1 shows an NaCl electrolysis cell EA1 having an anolyte circuit a and catholyte circuit b and a process gas circuit c with the conveying device P1. Chlorine gas d is discharged from the anode. A substream e is taken from the anolyte circuit and is, after dechlorination, utilized together with fresh water and solid sodium chloride for producing a saturated NaCl solution e' which is then, after purification, reintroduced into the circuit. A substream of sodium hydroxide solution f is taken from the catholyte circuit. A substream g is taken as purge from the process gas circuit c and fresh oxygen h from a cryogenic air fractionation plant is fed in. The temperature of the electrolysis cell is 90° C. The anolyte and catholyte circuits are cooled by means of the heat exchangers WA1 and WA2, respectively. The chlorine gas is cooled to about 40° C. in the heat exchanger WA3. Here, part of the water present in the chlorine gas condenses.

To heat the process gas to the desired temperature, the freshly introduced oxygen h is, in one embodiment of the invention, heated by means of the heat exchanger WA4. In another embodiment which is not shown here, heat exchange is preferably effected against the chlorine gas to be cooled by WA4 corresponding to WA3 and the oxygen being heated by direct heat exchange with the hot chlorine gas, with heat exchange preferably being carried out in countercurrent. However, heating can also be effected, in a further embodiment, by means of a heat transfer medium circuit, preferably by means of a water circuit, so that the heat removed in WA3 is transferred for heating the oxygen in WA4. In a further embodiment, the heat removed from WA1 or WA2 by means of a heat transfer medium circuit is utilized for heating the process gas in WA4.

In a further embodiment, the process gas c is, after discharge of the purge stream g and introduction of the oxygen h, heated to the required temperature in the heat exchanger WA5. In a variant not shown here, heat exchange is effected against the chlorine gas to be cooled by heat exchanger WA5 corresponding to the heat exchanger WA3 and the process gas being heated by direct heat exchange with the hot chlorine gas, with heat exchange preferably being carried out in countercurrent. However, heating can also be effected, in a further embodiment, by means of a heat transfer medium circuit, preferably by means of a water circuit, so that the heat removed in WA3 is transferred for heating the process gas in WA5. In a further embodiment, the heat removed from heat exchanger WA1 or heat exchanger WA2 by means of a heat transfer medium circuit is utilized for heating the process gas in WA5.

Example 2

Figure 2:
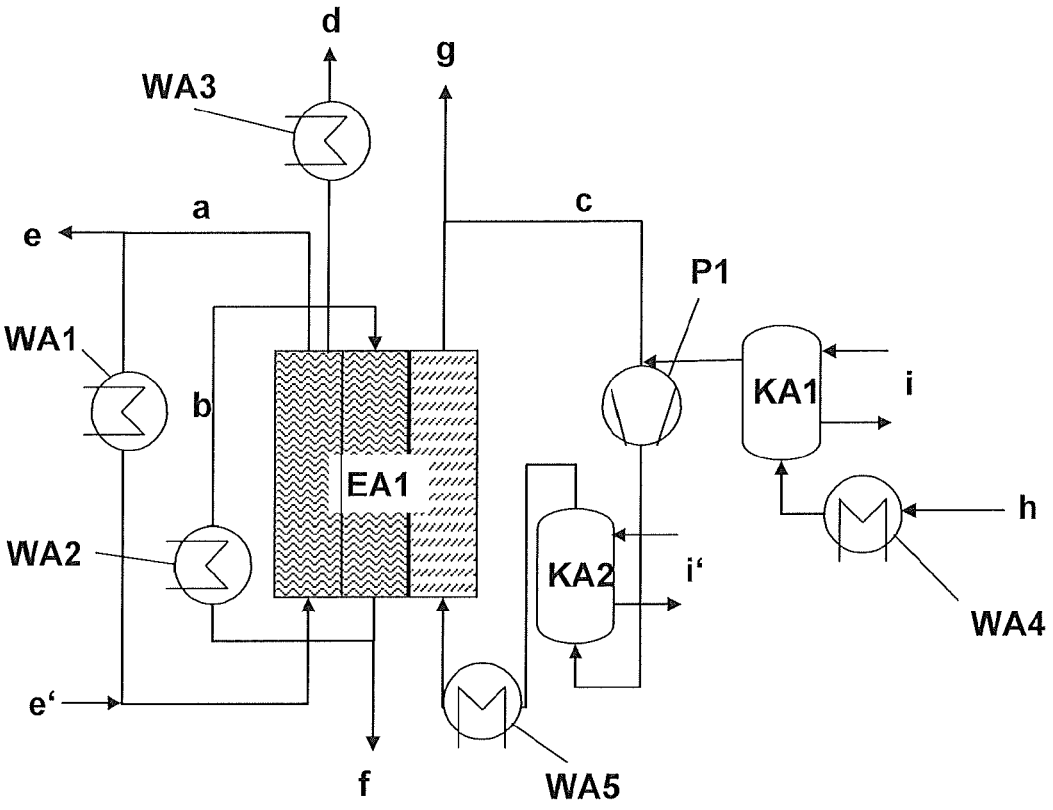

FIG. 2 shows, by way of example, further embodiments in which the process gas is additionally humidified.

In one embodiment, the freshly introduced oxygen h is heated in the heat exchanger WA1, with the heat energy coming, as in the above-described embodiments, from one of the sources heat exchanger WA3, WA2 or WM. The oxygen stream h is then passed through the humidification apparatus KA1 and the heated and humidified oxygen is introduced into the process gas circuit G. To effect humidification, an aqueous medium i, which is either deionized water, condensate or sodium hydroxide solution, is conveyed through the humidification apparatus KA1.

In a further embodiment, the process gas c is, after discharge of the purge stream (g) and introduction of the oxygen h, passed through the humidification apparatus KA2 and subsequently heated in the heat exchanger WA5, with the energy coming, as in the above-described embodiments, from one of the sources WA3, WA2 or WA1. To effect humidification, an aqueous medium i', which is either deionized water, condensate or sodium hydroxide solution, is conveyed through the humidification apparatus KA2.

Example 3

Figure 3:
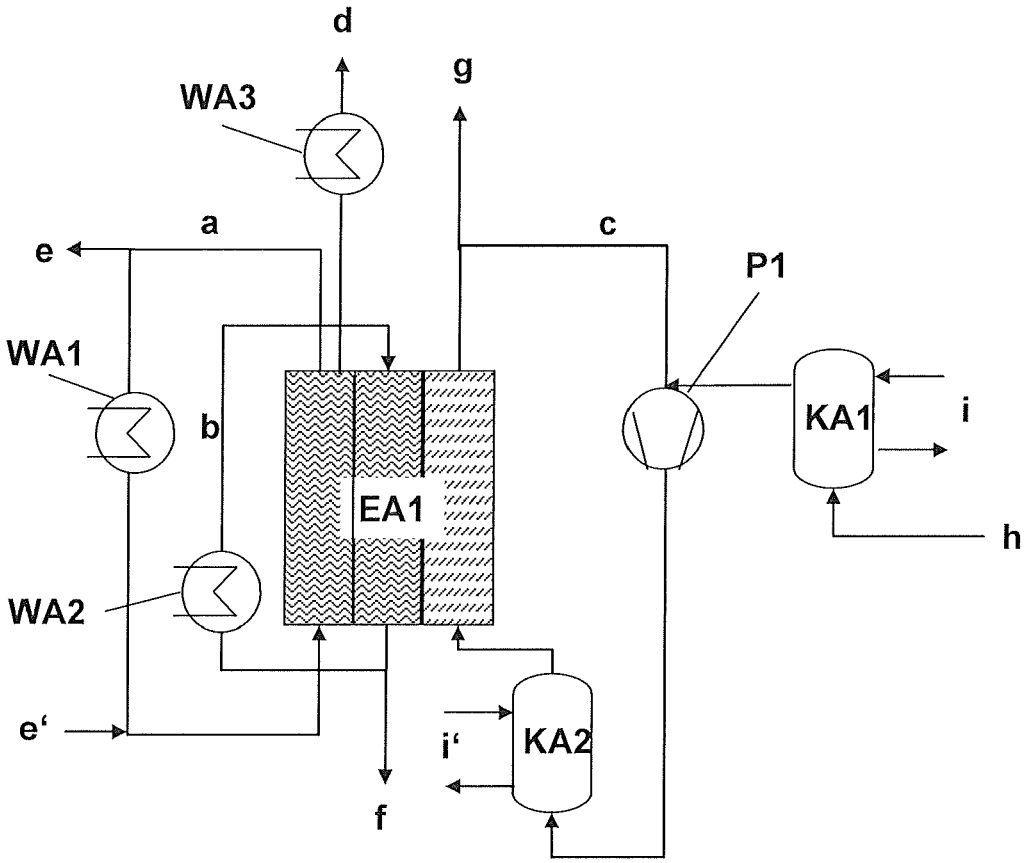

FIG. 3 shows further embodiments in which heating and humidification are carried out in one apparatus.

In one embodiment, the freshly introduced oxygen h is humidified and heated in the humidification apparatus KA1. The humidification apparatus KA1 is supplied with a hot aqueous medium i, which is hot condensate from the sodium hydroxide solution evaporation plant, hot sodium hydroxide solution (f), another hot aqueous stream from the process or deionized water which has been heated by means of the waste heat from one of the heat exchangers WA1, WA2 or WA3.

In a further embodiment, the process gas c is, after discharge of the purge stream g and introduction of the oxygen h, humidified and heated in the humidification apparatus KA2. The humidification apparatus KA2 is supplied with a hot aqueous medium i', which is hot condensate from the sodium hydroxide solution evaporation plant, hot sodium hydroxide solution f, another hot aqueous stream from the process or deionized water which has been heated by means of the waste heat from one of the heat exchangers WA1, WA2 or WA3.

Example 4

An NaCl solution having a concentration of 220 g/l is electrolyzed at a current density of 4 $kA/m^2$ in an electrolysis apparatus having 10 cell elements each of 2.7 $m^2$ and equipped with a Nafion membrane N982® from Dupont and an OCE. 33.8 standard $m^3/h$ of pure oxygen (>99% of $O_2$), i.e. a 50% excess, are fed into the cathode space.

The oxygen introduced has a temperature of 80° C. The temperature is achieved by heating the fresh oxygen by means of a heat exchanger in countercurrent against the chlorine gas discharged from the electrolysis apparatus before the fresh oxygen is mixed with the residual gas stream reduced by the purge gas stream. This corresponds to the embodiment shown in FIG. 1 with the modification that the heat exchangers WA3 and WA4 have been replaced by a single heat exchanger through which chlorine as heat transfer medium and fresh oxygen flow.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A method of operating an oxygen-consuming electrode as cathode for the electrolysis of alkali metal chlorides or hydrochloric acid, in an electrochemical cell, comprising feeding an oxygen-containing process gas to the electrode, wherein the oxygen-containing process gas is at least partly heated using a heat source from the electrolysis or from a work up process stream subsequent to the electrolysis before contact with the oxygen-consuming electrode to a temperature which corresponds to not more than the temperature of the cathode space in the cell or is less than 50° C. below the temperature of the cathode space in the cell;

wherein the heat source has a temperature of <150°.

2. The method according to claim 1, wherein the oxygen-containing process gas is at least partly heated by heat exchange with a selected process stream obtained from the electrolysis or by heat exchange with a worked-up process stream subsequent to the electrolysis.

3. The method according to claim 1, wherein the oxygen-consuming electrode is at least partly heated to a temperature which corresponds to not more than the temperature of the cathode space in the cell or is less than 20° C. below the temperature of the cathode space in the cell.

4. The method according to claim 1, wherein the oxygen-consuming electrode is at least partly heated to a temperature which corresponds to not more than the temperature of the cathode space in the cell or is less than 10° C. below the temperature of the cathode space in the cell.

5. The method according to claim 1, wherein chlorine gas taken off from the anode side of the electrochemical cell is utilized as a process stream for heat exchange for heating the oxygen-containing process gas.

6. The method according to claim 1, wherein catholyte and/or anolyte leaving the cell is utilized as a process stream for heat exchange for heating the oxygen-containing process gas.

7. The method according to claim 1, wherein cooling water, condensates or secondary steam from an alkali metal hydroxide solution evaporation plant downstream of the electrolysis cell is utilized as a process stream for the heat exchange for heating the oxygen-containing process gas.

8. The method according to claim 1, wherein the oxygen-containing process gas is at least partly heated by passing the oxygen-containing process gas through an alkali metal hydroxide solution discharged from a catholyte circuit.

9. The method according to claim 1, wherein condensed vapour from an alkali metal hydroxide solution evaporation downstream of the electrochemical cell is used as a process stream for heating the oxygen-containing process gas, wherein the oxygen-containing process gas is heated by passing the oxygen-containing process gas through the condensed vapour.

10. The method according to claim 1, wherein the oxygen-containing process gas fed to the electrode has a proportion of from 30 to 95% by volume of oxygen.

11. The method according to claim 1, wherein the oxygen-containing process gas fed to the electrode has a proportion of from 90 to 99% by volume of oxygen.

12. The method according to claim 1, wherein the oxygen-containing process gas fed to the electrode has a proportion of greater than 99% by volume of oxygen.

13. The method according to claim 1, wherein the oxygen-containing process gas fed to the electrode has a $CO_2$ content of <100 ppm.

14. The method according to claim 1, wherein the electrolysis is a chloralkali electrolysis.

15. The method according to claim 1, wherein the electrolysis is a sodium chloride electrolysis.

16. The method according to claim 1, wherein the electrolysis is a hydrochloric acid electrolysis.

* * * * *